US010279500B2

(12) United States Patent
Balsells Mercade

(10) Patent No.: US 10,279,500 B2
(45) Date of Patent: May 7, 2019

(54) MODULAR AND ADJUSTABLE SLIDING BASE

(71) Applicant: Manufacturas Y Transformados AB, S.L., Igualada (Barcelona) (ES)

(72) Inventor: Antonio Balsells Mercade, Igualada (ES)

(73) Assignee: MANUFACTURAS Y TRANSFORMADOS AB, S.L. (ES)

( * ) Notice: Subject to any disclaimer, the term of this patent is extended or adjusted under 35 U.S.C. 154(b) by 0 days.

(21) Appl. No.: 15/223,404

(22) Filed: Jul. 29, 2016

(65) Prior Publication Data

US 2017/0036366 A1 Feb. 9, 2017

(30) Foreign Application Priority Data

Aug. 5, 2015 (ES) ..... 201531166

(51) Int. Cl.

| | |
|---|---|
| ***B25H 1/16*** | (2006.01) |
| ***B26D 7/01*** | (2006.01) |
| ***B25B 11/00*** | (2006.01) |
| ***B65H 35/00*** | (2006.01) |

(52) U.S. Cl.

CPC ..... *B26D 7/018* (2013.01); *B25B 11/005* (2013.01); *B25H 1/16* (2013.01); *B65H 35/00* (2013.01)

(58) Field of Classification Search

CPC . B25H 1/00; B25H 1/16; B65G 39/02; B65G 39/04; B65G 39/12

See application file for complete search history.

(56) References Cited

U.S. PATENT DOCUMENTS 1,743,223 A * 1/1930 Lowy ..... B21B 39/008 193/37
1,778,267 A * 10/1930 McArthur ..... B65G 39/025 193/35 MD
1,812,861 A * 7/1931 Chase ..... B62B 3/0625 108/136
1,816,249 A * 7/1931 Brainard ..... A47B 17/03 108/136
2,289,514 A * 7/1942 Mastney ..... F16F 15/067 108/136
3,747,736 A * 7/1973 Kornylak ..... B65G 13/10 193/35 MD (Continued)

FOREIGN PATENT DOCUMENTS

DE 2415200 A1 10/1975
DE 202008016144 U1 4/2009

*Primary Examiner* — Tyrone V Hall, Jr.
(74) *Attorney, Agent, or Firm* — Hayes Soloway PC

(57) ABSTRACT

The present invention relates to a modular and adjustable sliding base, intended mainly for flexible or rigid sheet material cutting machines, but being able to be applied to any machinery requiring it. The base comprises an upper surface (1*a*) and a lower surface (1*b*), where said upper surface (1*a*) has a plurality of through holes (3) communicating the upper and lower surfaces, and a plurality of legs (4) on the lower surface for supporting the base (1). Some legs (4) having a through hole (4*a*) along the length of the leg and an elastic element (6) arranged around the perimeter of each leg (4) and having a threaded fixing element (5) that can be inserted in the through hole (4*a*) and emerging from the free end of the leg, for allowing height adjustment of each leg (4) on a support surface (2).

7 Claims, 3 Drawing Sheets

(56) References Cited

U.S. PATENT DOCUMENTS

| | | | | |
|---|---|---|---|---|
| 3,874,491 | A * | 4/1975 | Faure | B65G 13/10 193/35 MD |
| 4,142,286 | A * | 3/1979 | Knuth | H05K 3/3447 29/739 |
| 4,426,076 | A * | 1/1984 | Palmer | A63B 5/08 108/136 |
| 4,567,938 | A * | 2/1986 | Turner | H01L 21/67011 118/50 |
| 5,012,914 | A * | 5/1991 | Berends | B65G 13/10 198/369.4 |
| 5,553,837 | A | 9/1996 | Kahle | |
| 6,189,876 | B1 * | 2/2001 | Frazier | B25B 11/005 269/21 |
| 2012/0018938 | A1 | 1/2012 | Cone et al. | |
| 2014/0151182 | A1 * | 6/2014 | Poehlein | B65G 13/12 193/37 |

* cited by examiner

MODULAR AND ADJUSTABLE SLIDING BASE

TECHNICAL FIELD OF THE INVENTION

The present invention relates to a modular and adjustable sliding base, intended mainly for flexible or rigid sheet material cutting machines, but being able to be applied to any machinery requiring it.

The main purpose of the modular and adjustable sliding base object of the invention is to enable having a perfectly flat and adjustable surface for arranging different types of stationary or moving surfaces thereon to enable cutting the different sheet materials on it with the corresponding cutting machine, such that both perfect flatness and great flexibility and modularity for creation of different flat surface areas suitable for forming with said base are assured; and all this with a base formed by simple physical entities easily positioned and handled by a user, and perfectly applicable to the industrial sectors existing today.

BACKGROUND OF THE INVENTION

The use and application of bases for sheet material cutting machines are known; such that said bases must have a flatness geometric tolerance along the length and width of their entire surface with a very small value to thereby enable assuring the most precise possible cut.

In this sense, the use of bases as such is known, working as support surfaces, and in which the work surface suitable for cutting the different sheet materials with the corresponding cutting machine is positioned and retained by means of applying a vacuum. By way of example, for better understanding and in a non-limiting manner, said work surfaces which are positioned on the support surface formed by the sliding bases object of the patent, can be pieces of porous sheet materials, being able to be plastics such as PU, or textile materials, conveyor belts, brushes for cutting, etc. Current support surfaces have a series of drawbacks:

The extreme difficulty in achieving very precise flatness geometric tolerances is first pointed out because they tend to be bases which have large surface dimensions and are manufactured in different modules creating discontinuities between them, which manifest when cutting the sheet material. To achieve a good base finish and surface tolerance, the cost of the base is increased. Furthermore, the surfaces required for making cuts on sheet materials bases is currently very expensive because it requires high precision and the machining process thereof is complex.

Finally, and as regards the method for cutting the sheet material, the work surface installed on the bases must be able to slide in some of the applications (depending on the sheet material to be cut), which is extremely difficult because said base only serves as a support and does not have the capacity to allow the work surface to move and slide thereon.

The development of a new base for sheet material cutting machines capable of solving the preceding problems is necessary, such that it allows easily adjusting the base for correct leveling, thereby assuring a high degree of flatness throughout the entire cutting surface of the sheet material, without this translating into a direct cost of the base. This leveling capacity in turn makes an expensive, high-precision structure unnecessary.

DESCRIPTION OF THE INVENTION

The present invention relates to a modular and adjustable sliding base for sheet material cutting machines, comprising an upper surface, which will be the support surface, and a lower surface, where said upper surface has a plurality of through holes for applying a vacuum to the upper surface, as is known in the current state of the art, the purpose of said holes being to create suction on the sheet material to be cut, preventing it from being driven by the corresponding cutting machine; and where the size of said holes is sufficient to allow the absorption of dust particles or the like, without causing obstruction thereof during operation, keeping the surface of the sliding base clean for the most part.

Additionally, the base object of the invention has a plurality of legs, where each leg in turn comprises: a through hole axially configured for housing a fixing element along the length of each leg; and an elastic element placed around the perimeter of some or all legs, allowing the height adjustment of each leg on a support surface as a result of modifying the thread depth of each fixing element with respect to the mechanical structure supporting these bases, the cutting surfaces, the sheet material to be cut as well as the guides and mechanical elements necessary for the correct operation of the different types of cutting heads.

These elements allow assuring a perfect flatness regardless of the support surface or mechanical structure to which it is coupled since, as can be seen, said each leg, where said fixing element is threaded onto the support surface in corresponding drilled holes, such that the base is fixed thereto in a simple and quick manner.

To assure height adjustment, the thread length of each fixing element with respect to the support surface is gradually modified, where the elastic elements assure that the base does not fall on the surface of the cutting machine due to the action of gravity since said elastic elements come into contact with the support surface before the legs do, the fixing elements therefore being the entities fixing and adjusting the height, and the elastic elements being the entities assuring the flatness position of the base object of the invention.

Therefore, when the surface of the cutting machine has irregularities, it is only necessary to act on the leg closest to said irregularities and modify the height until achieving the desired flatness.

It must be highlighted that if the surface of the cutting machine where the base object of the invention is installed is flat enough, then said base can be installed without fixing elements or elastic elements, since said base can be positioned with gravitational force alone, reducing the time for assembling it on the surface.

As a preferred embodiment, the option in which each fixing element housed in the through hole of each leg is a screw is highlighted, the head of which screw is embedded in the upper surface of the base, advantageously being able to be actuated from the upper part of said base. In a parallel manner, each elastic element is a coil spring coupled at one end to each leg and the other end overhangs until it comes into contact with the corresponding support surface.

In order to assure sliding of the work surface or any object to be moved on the sliding bases, the upper surface comprises, with respect to the base, a plurality of cavities configured for allowing the housing of rollers, respectively. The upper surface is therefore provided in a simple but effective manner with rollers on which the work surface or any object to be moved is supported, and where said rollers rotate freely, which assures sliding of the work surface or any object to be moved on said base.

Particularly and optionally, each cavity has a cylindrical perforation and two half bearings made in said base configured for allowing the support and free rotation of each roller with respect to each cavity. Therefore, the base already has, supported in the corresponding half bearings, and they can be replaced or eliminated anytime the user wishes.

Optionally, each rotation axis of the cylindrical perforation of each cavity is inclined a specific angle with respect to the rotation axis of the cylindrical perforations of the contiguous cavities. Channels forcing the passage and sliding of the work surface with respect to the base are therefore created, seeking at all times the direction towards the inside of the base where the sheet material is to be cut, preventing the work surface from moving laterally, thereby achieving uniform linear movement, preventing folds or areas with different stresses.

The base can have a plurality of non-adjustable legs located in the inner area of the lower surface of the base itself and having the purpose of distributing the pressure to be exerted by the cutting machine when it acts on the sheet material and said base, although said pressure distribution is done fundamentally when neither the elastic elements nor the coupling elements are positioned on the rest of the adjustable legs.

Said non-adjustable legs can be converted into adjustable legs with the simple addition of flexible elements and fixing elements therein, in the event that the surface of the cutting machine is highly irregular.

Therefore, with the proposed invention an adjustable base is obtained for sheet material cutting machines capable of providing a perfectly flat surface for arranging the corresponding work surface thereon, and for subsequent cutting with the cutting machine, associated with the material arranged in the upper part of this sliding surface, arranged on the bases object of the application; assuring perfect flatness as well as great flexibility and modularity for creation, offering the possibility of creating cutting surfaces of different sizes; and all this with a base formed with simple elements, perfectly applicable to the cutting machinery existing today.

DESCRIPTION OF THE DRAWINGS

To complement the description that is being made and for the purpose of aiding to better understand the features of the invention according to a preferred practical embodiment thereof, a set of drawings is attached as an integral part of said description in which the following has been depicted with an illustrative and non-limiting character.

PREFERRED EMBODIMENT OF THE INVENTION

Figure 1:
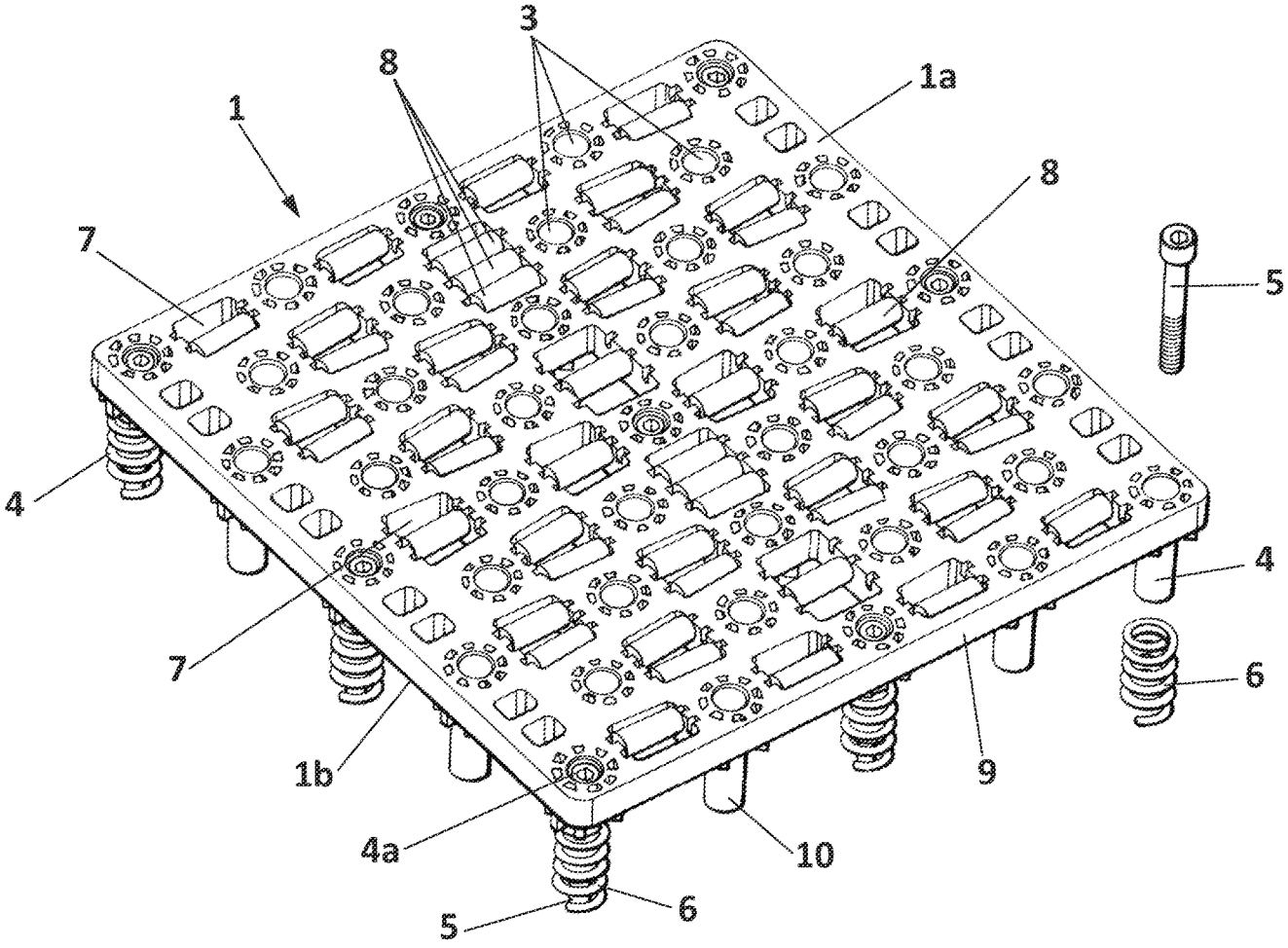
FIG. 1 shows a first perspective view of the base for sheet material cutting exploded view.

FIGS. 1 to 5 show how the base (1) for sheet material cutting machines comprises an upper surface (1*a*) and a lower surface (1*b*), where said upper surface (1*a*) has a plurality of through holes (3) configured for transmitting a negative pressure by means of vacuum to the upper surface (1*a*).

Furthermore, the base has a plurality of adjustable legs (4) comprising a through hole (4*a*) configured for housing an Allen screw (5) along the length of each leg (4), and a coil spring (6) coupled around the perimeter of each leg (4), allowing the height adjustment of each leg (4) on the surface (2) of a cutting machine by means of modifying the thread depth of each fixing element (5) with respect to said surface (2) of the cutting machine, and thereby perfectly leveling the upper surface (1*a*).

Therefore, the method for assembling said base (1) on the surface (2) of the cutting machine consists of:

a) placing the base (1) on the surface (2) of the cutting machine;

b) screwing the fixing elements (5) of each leg (4) into threaded holes c) leveling the upper surface (1*a*) of the base (1) by modifying the thread depth of the necessary fixing elements (5) until obtaining perfect leveling. This leveling is advantageously done from the upper surface.

Therefore, although the surface (2) of the cutting machine does not have a correct or minimum flatness for the correct cutting of the sheet material, only adjusting the screws (5) with respect to the surface (2) of the cutting machine allows successfully modifying the height of the different areas of the upper surfaces (1*a*) of the bases (1); and where the purpose of the coil spring (6) is to prevent the legs (4, 10) of the base (1) from being supported as a result of gravitational pull on the surface (2) of the cutting machine, and therefore without the possibility of being adjusted by the user.

Figure 2:
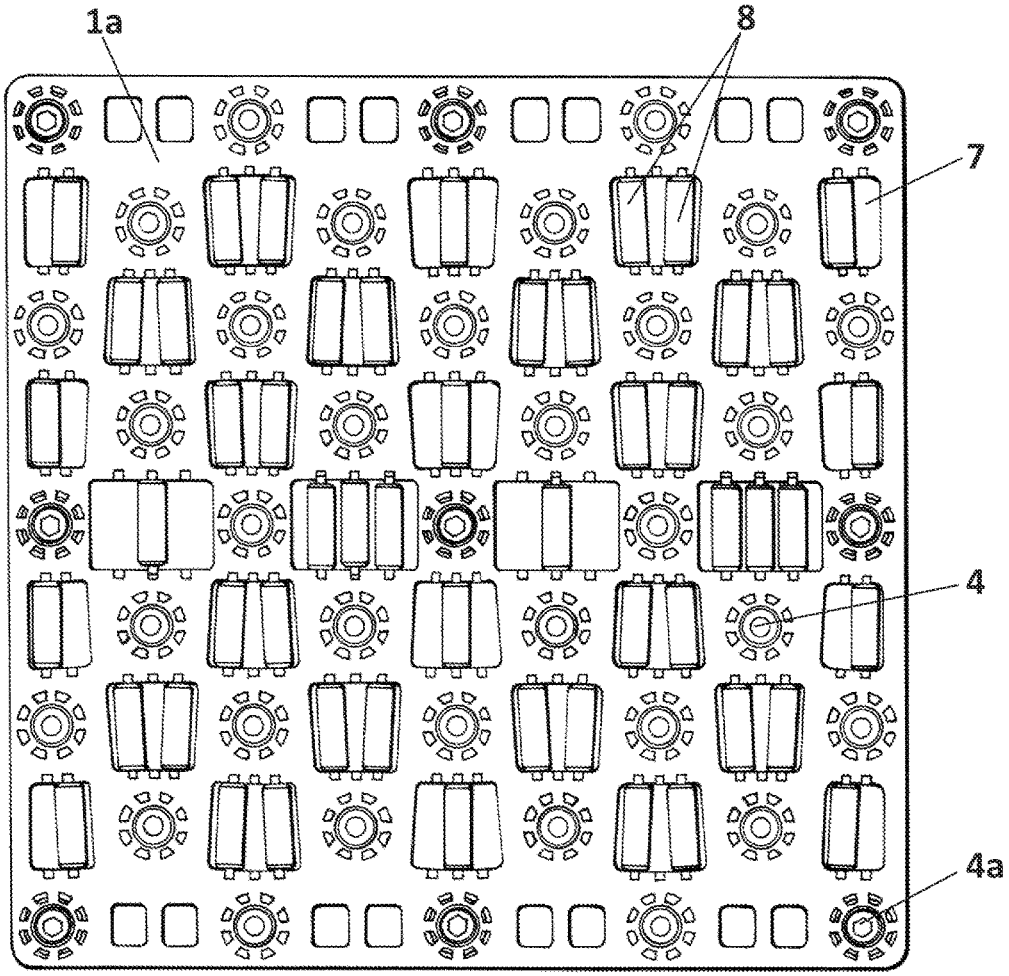
FIG. 2 shows a plan view of the base for sheet material cutting machines object of the invention, depicting the orientation of the cavities, and therefore of the sliding rollers of the work surface. It must be pointed out that the length and arrangement of said rollers, either perpendicular to the direction of sliding or with a slight angle with respect to this, are variable, this FIG. 2 being illustrative but non-limiting.
Figure 5:
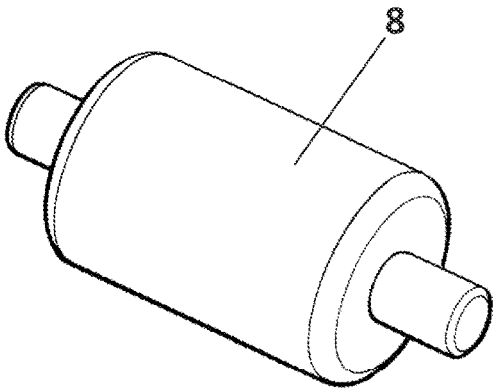
FIG. 5 shows a perspective view of the roller to be coupled in the different cavities of the upper surface of the base for sheet material cutting machines object of the invention. These rollers can have a different length or diameter to optimize the sliding of each cutting surface.

Likewise, FIGS. 1 and 2 show how the upper surface (1*a*) comprises a plurality of cavities (7) configured for allowing the housing of rollers (8), respectively, which can be seen in detail in FIG. 5, where each cavity (7) has a cylindrical perforation and at least two half bearings made in said base (1) configured for allowing support by means of gravity and free rotation of each roller (8) with respect to each cavity (7).

Likewise, FIG. 2 shows how the rotation axes of the cylindrical perforation of each cavity (7) are inclined at a specific angle with respect to the other axes for the purpose of achieving linear movement of the surface, preventing lateral movements. Therefore, as can be seen, the cylinders can be arranged perpendicular to the direction of movement of the surface or parallel. The base is formed such that the cavities allow housing one or more cylinders of different length and diameter, and these cavities in turn have half bearings which allow housing the cylinder or cylinders such that their rotation is perpendicular or with a slight angle with respect to the direction of sliding of the sliding surface acting as a support for the sheet material which will be cut.

Figure 3:
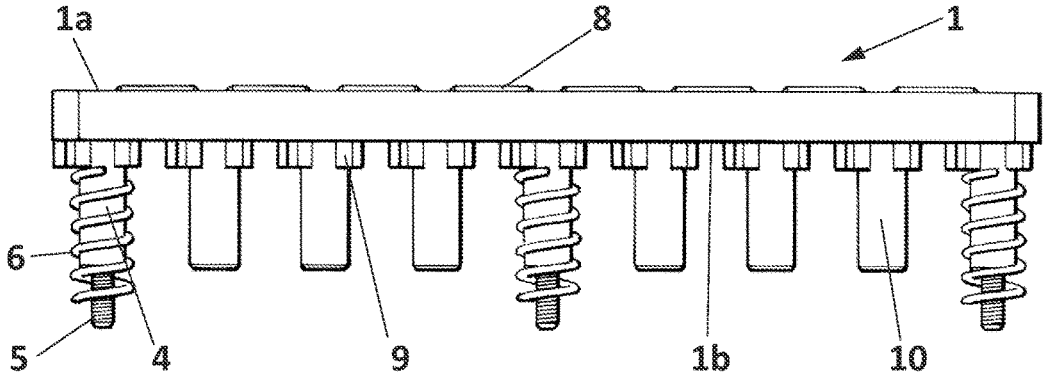
FIG. 3 shows an elevational view of the base for sheet material cutting machines object of the invention, depicting the greater length which the elastic elements and fixing elements have with respect to the legs, for subsequent screwing onto the support structure or surface.

FIGS. 1 and 3 show how the base (1) object of the invention has a plurality of non-adjustable legs (10) located in the inner area of the lower surface (1*b*) of the base (1) for assuring pressure distribution throughout the entire upper surface (1*a*) of the base (1). Said legs (10) can be converted into adjustable legs (4) with the simple addition of screws (5) and springs (6).

Figure 4:
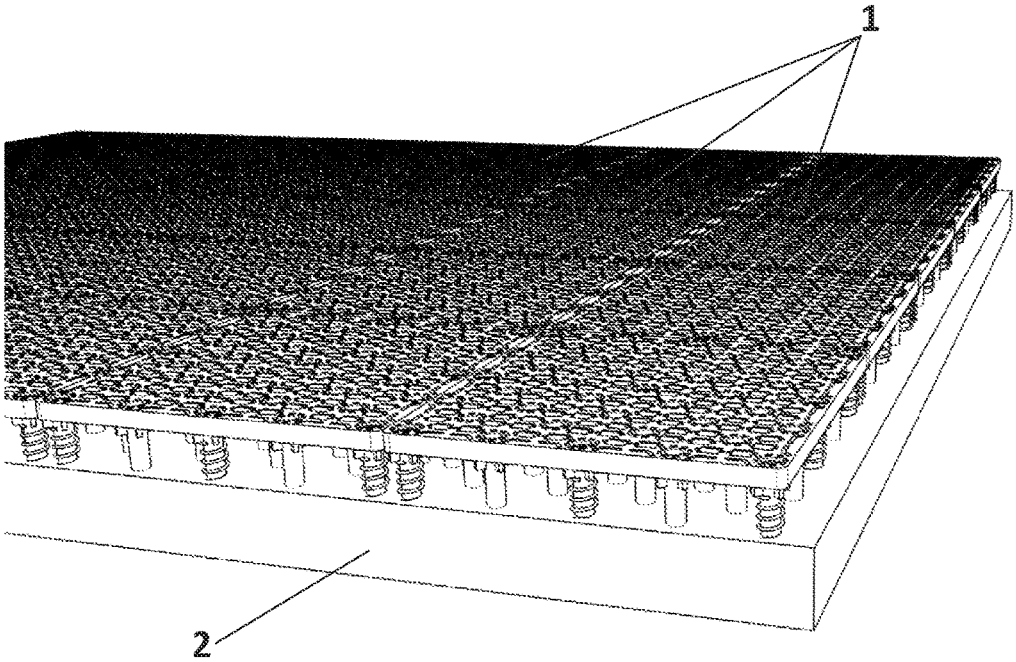
FIG. 4 shows another perspective view of an assembly of bases for sheet material cutting machines, coupled to one another and supported on the surface of the cutting machine, creating a cutting surface as large as required.

FIG. 4 shows a plurality of bases (1) coupled to one another through respective coupling means (9) between the different bases (1) and located on the example, of a tongue and groove joint, simple butt joint, or using additional attachment parts.

In this sense, it is described that the base (1) is formed with a plastic material, which allows making a series of bases (1) with a single mold, reducing the cost of the process for forming said base (1), where furthermore, said plastic can give rise to an upper surface (1*a*) with different surface finish or sliding properties depending on each work surface to be installed on the bases.

Similarly, the rollers (8) are made of a plastic or metallic material, or even mixed rollers made of several materials are possible, depending on the sheet material and the application desired by the user, the latter being perfectly interchangeable with one another.

In view of this description and set of drawings, the person skilled in the art will understand that the embodiments of the invention which have been described can be combined in many ways within the object of the invention. The invention has been described according to several preferred embodiments thereof, but for the person skilled in the art it will be obvious that multiple variations can be introduced in said preferred embodiments without exceeding the object of the claimed invention.

The invention claimed is:

1. A modular and adjustable sliding base, comprising an upper surface and a lower surface, where said upper surface has a plurality of through holes communicating the upper and lower surfaces, and a plurality of legs on the lower surface for supporting the base, the base further comprising legs having a through hole along the length of the leg and an elastic element arranged around the perimeter of each leg and having a threaded fixing element that can be inserted in the through hole and emerging from the free end of the leg, for allowing height adjustment of each leg on a support surface as a result of modifying the thread depth of each fixing element with respect to said support surface; and wherein the upper surface comprises a plurality of cavities, and in that each cavity has a perforation and several pairs of half bearings in said base configured for receiving and allowing the support and free rotation of rollers, with respect to each cavity and wherein each pair of half bearings define an axis of rotation, and wherein each axis of the half bearings of each cavity are inclined a specific angle with respect to the rest of axis within the same cavity.

2. The modular and adjustable sliding base according to claim 1, characterized in that said fixing elements housed in the through hole of each leg is a screw the head of which is embedded in the upper surface of the base.

3. The modular and adjustable sliding base according to claim 1, characterized in that it has a plurality of non-adjustable legs located in the inner area of the lower surface of the base.

4. The modular and adjustable sliding base according to claim 1, characterized in that it is made of a plastic material.

5. The modular and adjustable sliding base according to claim 1, characterized in that the elastic elements are springs the length at rest of which is greater than the length of the legs to which they are coupled.

6. The modular and adjustable sliding base according to claim 1, further comprising a plurality of rollers (8), wherein each roller comprises one of plastic, metal, and a combination of plastic and metal, wherein each roller is coupled to a pair of half bearings.

7. The modular and adjustable sliding base according to claim 1, further comprising a negative pressure environment between the base and the support surface, whereby the negative pressure provides suction through the through holes.

* * * * *